US007155925B2

(12) United States Patent
Yamasaki et al.

(10) Patent No.: US 7,155,925 B2
(45) Date of Patent: Jan. 2, 2007

(54) REFRIGERANT CYCLE APPARATUS

(75) Inventors: Haruhisa Yamasaki, Ora-gun (JP); Masaji Yamanaka, Tatebayashi (JP); Kazuaki Fujiwara, Ota (JP); Tsunehisa Yumoto, Ashikaga (JP); Shigeya Ishigaki, Ora-gun (JP); Kenzo Matsumoto, Ora-gun (JP)

(73) Assignee: Sanyo Electric Co., Ltd., Osaka (JP)

( * ) Notice: Subject to any disclaimer, the term of this patent is extended or adjusted under 35 U.S.C. 154(b) by 9 days.

(21) Appl. No.: 10/777,220

(22) Filed: Feb. 13, 2004

(65) Prior Publication Data

US 2004/0211216 A1 Oct. 28, 2004

(30) Foreign Application Priority Data

Mar. 27, 2003 (JP) ..... 2003-088278

(51) Int. Cl.

| | |
|---|---|
| ***F25D 17/06*** | (2006.01) |
| ***F25B 1/00*** | (2006.01) |
| ***F25B 39/04*** | (2006.01) |
| ***F25B 1/10*** | (2006.01) |

(52) U.S. Cl. ..... 62/428; 62/498; 62/507; 62/510

(58) Field of Classification Search ..... 62/498, 62/510, 506, 507, 428, 429, 181, 183, 184
See application file for complete search history.

(56) References Cited

U.S. PATENT DOCUMENTS 6,155,074 A * 12/2000 Jung et al. ..... 62/506
6,658,888 B1 * 12/2003 Manohar et al. ..... 62/498

FOREIGN PATENT DOCUMENTS

JP 7-18602 3/1995

* cited by examiner

*Primary Examiner*—Marc Norman
(74) *Attorney, Agent, or Firm*—Westerman, Hattori, Daniels & Adrian, LLP

(57) ABSTRACT

It is an object of the present invention to provide a refrigerant cycle apparatus which can optimize the capability of releasing heat from a refrigerant in a gas cooler and an auxiliary heat exchanger under use conditions at a low cost. There are provided an intermediate cooling circuit which once releases heat from a refrigerant discharged from a compressor and then returns the refrigerant to the compressor, and a fan which ventilates an inter cooler of the intermediate cooling circuit and a gas cooler. The inter cooler has substantially the same ventilation area as that of the gas cooler.

4 Claims, 5 Drawing Sheets

REFRIGERANT CYCLE APPARATUS

BACKGROUND OF THE INVENTION

The present invention relates to a refrigerant cycle apparatus constituted by sequentially connecting a compressor, a gas cooler, throttling means and an evaporator.

In this type of conventional cycle apparatus, a refrigerant cycle (refrigerant circuit) is constituted by sequentially piping and connecting a rotary compressor (compressor), a gas cooler, throttling means (expansion valve or the like), an evaporator and others in an annular form. Further, a refrigerant gas is taken in to a low-pressure chamber side of a cylinder from an intake port of a rotary compression element of the rotary compressor, and a refrigerant gas with a high temperature and a high pressure is obtained by compression performed by operations of a roller and a vane. This gas is then discharged to the gas cooler from a high-pressure chamber side through a discharge port and a discharge sound absorbing chamber. The gas cooler releases heat from the refrigerant gas, then this gas is squeezed by the throttling means and supplied to the evaporator. The refrigerant is evaporated in the evaporator, and a cooling effect is demonstrated by performing the endotherm from the periphery at this time.

Here, in order to cope with global environment problems in recent years, there has been developed an apparatus which utilizes carbon dioxide ($CO_2$) which is a natural refrigerant even in this type of refrigerant cycle without employing conventional fluorocarbon and uses a refrigerant cycle which operates with a high-pressure side as a supercritical pressure.

In such a refrigerant cycle apparatus, in order to prevent a liquid refrigerant from returning into the compressor which results in liquid compression, an accumulator is arranged on a low-pressure side between an outlet side of the evaporator and an intake side of the compressor, the liquid refrigerant is stored in this accumulator, and only the gas is taken into the compressor. Further, throttling means is adjusted so as to prevent the liquid refrigerant in the accumulator from returning to the compressor (see, e.g., Japanese patent Application Laid-open No. 1995/18602).

However, providing the accumulator on the low-pressure side of the refrigerant cycle requires a larger filling quantity of refrigerant. Furthermore, an opening of the throttling means must be reduced in order to avoid return of the liquid, or a capacity of the accumulator must be increased, which results in a reduction in the cooling capability or an increase in an installation space. Thus, in order to eliminate the liquid compression in the compressor without providing such an accumulator, the present applicant tried developing a refrigerant cycle apparatus shown in FIG. 4 of a conventional example.

In FIG. 4, reference numeral 10 denotes an internal intermediate pressure type multistage (two-stage) compressive rotary compressor, and it is constituted of an electric element 14 as a driving element in a sealed vessel 12, and a first rotary compression element 32 and a second rotary compression element 34 which are driven by a rotary shaft 16 of the electric element 14.

A description will be given as to an operation of a refrigerant cycle apparatus in this case. A refrigerant having a low pressure sucked from a refrigerant introducing tube 94 of the compressor 10 is caused to have an intermediate pressure when compressed by the first rotary compression element 32, and then it is discharged into the sealed vessel 12. Thereafter, this refrigerant enters a refrigerant introducing tube 92A, and flows into an intermediate cooling circuit 150A as an auxiliary cooling circuit. This intermediate cooling circuit 150A is provided so as to pass an inter cooler provided in a heat exchanger 154A, and heat radiation is performed there by an air cooling method. Here, heat of the refrigerant having an intermediate pressure is taken by the heat exchanger 154A. Thereafter, the refrigerant is sucked into the second rotary compression element 34 from a refrigerant introducing tube 92B, the second compression is carried out, the refrigerant is turned into a refrigerant gas having a high temperature and a high pressure, and it is discharged to the outside through a refrigerant discharge tube 96.

The refrigerant gas discharged from the refrigerant discharge tube 96 flows into a gas cooler provided in the heat exchanger 154A, heat radiation is performed in the gas cooler by the air cooling method, and this gas then passes through an internal heat exchanger 160. Heat of the refrigerant is taken by a refrigerant on the low-pressure side which has flowed out from an evaporator 157, and this refrigerant is further cooled. Thereafter, the refrigerant is depressurized by an expansion valve 156, and a gas/liquid mixed state is obtained in this process, and then the refrigerant flows into the evaporator 157 where it is evaporated. The refrigerant which has flowed out from the evaporator 157 passes through the internal heat exchanger 160, and it is heated by taking heat from the refrigerant on the high-pressure side in the internal heat exchanger 160.

Moreover, a cycle that the refrigerant heated in the internal heat exchanger 160 is sucked into the first rotary compression element 32 of the rotary compressor 10 from the refrigerant introducing tube 94 is repeated. A degree of superheat can be taken by heating the refrigerant which has flowed out from the evaporator 157 by the internal heat exchanger 160 using the refrigerant on the high-pressure side, return of the liquid that the liquid refrigerant is sucked into the compressor 10 can be assuredly avoided without providing an accumulator or the like on the low-pressure side, and an inconvenience that the compressor 10 is damaged by liquid compression can be eliminated.

Additionally, effective cooling can be performed in the inter cooler of the heat exchanger 154A by passing the refrigerant compressed by the first rotary compression element 32 through the intermediate cooling circuit 150A, thereby improving a compression efficiency of the second rotary compression element 34.

On the other hand, the heat exchanger 154A is constituted of the gas cooler and the inter cooler of the intermediate cooling circuit 150 as described above. A description will now be given as to a structure when, e.g., a micro-tube heat exchanger 154A is used in the refrigerant cycle apparatus with reference to FIG. 5. As shown in FIG. 5, in the heat exchanger 154A, an inter cooler 151A is arranged on the upper side, and a gas cooler 155A is arranged on the lower side. A refrigerant introducing tube 92A connected with the inside of a sealed vessel 12 of a compressor 10 is connected with headers 201 at an inlet of the inter cooler 151A. The headers 201 are connected with ends of respective micro-tubes 204 on one side, and they divide the refrigerant into a plurality of flows which are passed to a plurality of small refrigerant paths formed to the micro-tubes 204. Each of the micro-tubes 204 has a substantial U shape, and a plurality of fins 205 are attached at the U-shaped part. Further, ends of the micro-tubes 204 on the other side are connected with a header 202 at an outlet of the inter cooler 151A, and the refrigerants which have flowed through the respective small refrigerant paths flow into each other here. The header 202 at the outlet is connected with a refrigerant introducing tube 92B connected with a second rotary compression element 34 of the compressor 10.

Furthermore, the refrigerant compressed by the first rotary compression element 32 flows into the headers 201 at the inlet of the inter cooler 151A of the heat exchanger 154A from the refrigerant introducing tube 92A, it is divided into a plurality of flows, these flows enter the small refrigerant paths in the micro-tubes 204, and the refrigerants release heat upon receiving ventilation of a fan 211 at the step that they pass through the small refrigerant paths. Thereafter, the refrigerants flow into each other at the header 202 at the outlet, the refrigerant flows out from the heat exchanger 154A, and it is sucked into the second rotary compression element 34 from the refrigerant introducing tube 92B.

Moreover, a refrigerant discharge tube 96 of the compressor 10 is connected with headers 207 at the inlet of a gas cooler 155*a*. The headers 207 are connected with the ends of the respective micro-tubes 210 on one side, and divide the refrigerant into a plurality of flows which are caused to pass through small refrigerant paths formed in the micro-tubes 210. Each of the micro-tubes 210 is formed into a meandering shape, and a plurality of fins 205 are disposed to the meandering part. Further, ends of the micro-tubes 201 on the other side are connected to a header 208 at an outlet of the gas cooler 155A, and the refrigerants which have flowed through the respective small refrigerant paths of the micro-tubes 210 flow into each other here. The header 208 at the outlet is connected with a pipe running through the internal heat exchanger 160.

Furthermore, the refrigerant discharged from the second rotary compression element 34 of the compressor 10 flows into headers 207 at an inlet of the gas cooler 155A of the heat exchanger 154 from the refrigerant discharge tube 96, and is divided into a plurality of flows which enter the small refrigerant paths in the micro-tubes 210. The divided refrigerants release heat upon receiving ventilation of a fan 211 in the process of passing through these paths. Thereafter, the refrigerants flow into each other in the header 208 at the outlet. Then, the refrigerant flows out from the heat exchanger 154A and passes through the internal heat exchanger 160.

Constituting the heat exchanger 154A by using the gas cooler 155A and the inter cooler 151A of the internal cooling circuit 150A in this manner does not require separately forming the gas cooler 155A and the inter cooler 151A of the refrigerant cycle apparatus. Therefore, an installation space can be reduced.

In the refrigerant cycle apparatus including the heat exchanger 154A, a ratio in heat radiation capability of the gas cooler 155A of the heat exchanger 154A and the inter cooler 151A must be changed in accordance with use conditions. That is, in cases where the refrigerant cycle apparatus is used as a regular cooling apparatus, it is desired to improve the cooling efficiency (refrigerating efficiency) in the evaporator 157 by effectively cooling the refrigerant gas discharged from the second rotary compression element 34 even if a refrigerant circulating quantity in the refrigerant cycle is large. Therefore, it is necessary to set the heat radiation capability of the gas cooler 155A so as to be relatively high.

On the other hand, in cases where the refrigerant cycle apparatus is used as a cooling apparatus for a super-low temperature by which a temperature of a cooled space becomes not more than −30° C., it is desired to evaporate the refrigerant in a super-low temperature area in the evaporator 157 by suppressing an increase in temperature of the refrigerant gas discharged from the second rotary compression element 34 by increasing a flow path resistance of the expansion valve 156 or improving the heat radiation capability of the refrigerant in the intermediate cooling circuit 150. Therefore, it is necessary to set the head radiation capability of the inter cooler 151A of the intermediate cooling circuit 150 so as to be relatively high.

However, in the conventional heat exchanger 154A, since the micro-tubes 204 and 210 used in the gas cooler 155A in the heat exchanger 154A and the inter cooler 151A have different shapes, the design must be changed each time. Therefore, there is generated a problem of an increase in manufacturing cost.

SUMMARY OF THE INVENTION

In order to eliminate the above-described technical problems of the prior art, it is an object of the present invention to provide a refrigerant cycle apparatus which can optimize a heat radiation capability of a refrigerant in a gas cooler and an auxiliary refrigerant circuit in accordance with use conditions at a low cost.

That is, according to a refrigerant cycle apparatus of the present invention, an auxiliary cooling circuit which once releases heat of a refrigerant discharged from a compressor and then returns the refrigerant to the compressor and a fan used to ventilate the auxiliary cooling circuit and a gas cooler are provided, and a ventilation area of the auxiliary cooling circuit and that of the gas cooler are substantially the same. Therefore, for example, arranging the gas cooler on the upstream side of the auxiliary cooling circuit with respect to ventilation by the fan can effectively cooling the gas cooler by air-cooling ventilation.

Furthermore, in the refrigerant cycle apparatus according to the present invention, in addition to the above-described invention, the compressor includes first and second compression elements, and a refrigerant compressed by the first compression element and discharged is sucked into the second compression element through the auxiliary cooling circuit and compressed and discharged to the gas cooler. Moreover, the auxiliary cooling circuit is arranged on the upstream side of the gas cooler with respect to ventilation by the fan. Therefore, the auxiliary refrigerant circuit can be effectively cooled by air-cooling ventilation.

Additionally, in the refrigerant cycle apparatus according to the present invention, in addition to each of the above-described inventions, the auxiliary cooling circuit and the gas cooler are constituted by using a micro-tube heat exchanger.

DETAILED DESCRIPTION OF THE PREFERRED EMBODIMENT

Figure 1:
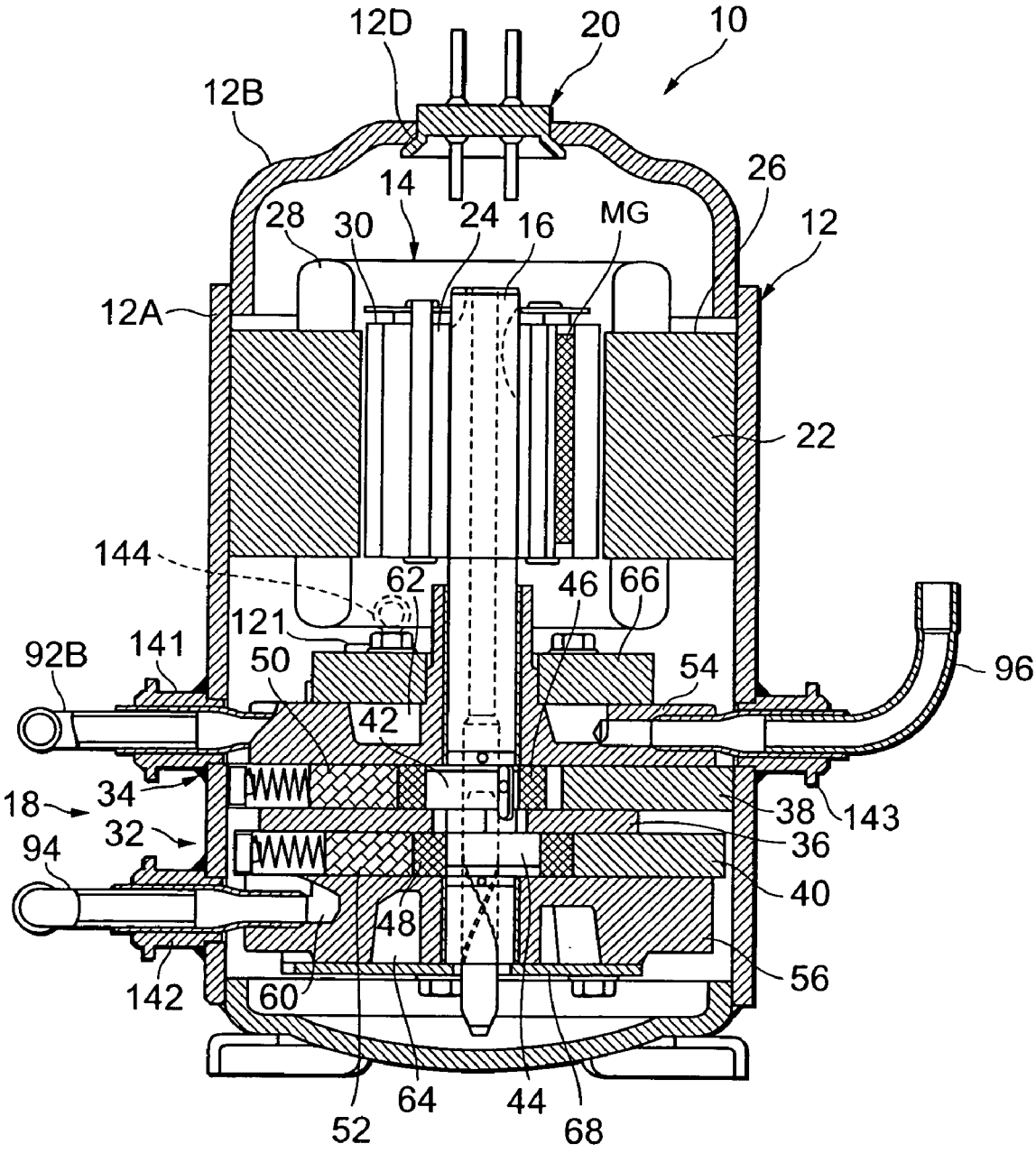
FIG. 1 is a vertical cross-sectional view of a rotary compressor as an embodiment used in a refrigerant cycle apparatus according to the present invention.
Figure 2:
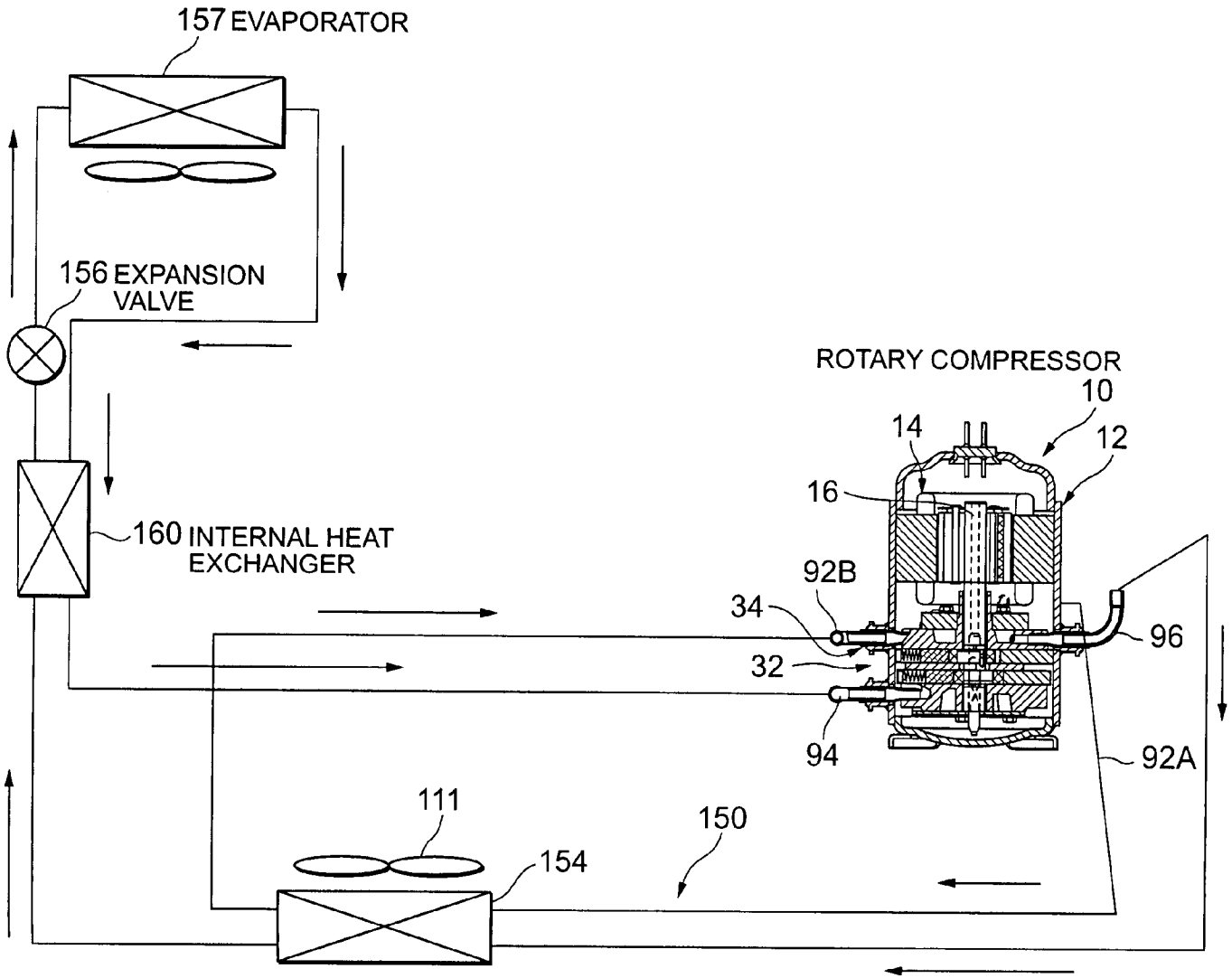
FIG. 2 is a refrigerant circuit diagram of the refrigerant cycle apparatus according to the present invention.

An embodiment according to the present invention will now be described in detail with reference to the accompanying drawings. FIG. 1 is a vertical cross-sectional view showing an internal intermediate pressure type multistage (two-stage) type compressive rotary compressor 10 which includes a first rotary compression element (first compression element) 32 and a second rotary compression element (second compression element) 34, as an embodiment of a compressor used in a refrigerant cycle apparatus according to the present invention, and FIG. 2 is a refrigerant circuit diagram showing a refrigerant cycle apparatus according to the present invention.

In each drawing, reference numeral 10 denotes an internal intermediate pressure type multistage compressive rotary compressor which uses carbon dioxide ($CO_2$) as a refrigerant, and this compressor 10 is constituted of a cylindrical sealed vessel 12 formed of a steel plate, an electric element 14 as a drive element which is arranged and accommodated on the upper side in an internal space of the sealed vessel 12, and a rotary compression mechanism portion 18 which is arranged on the lower side of the electric element 14, driven by a rotary shaft 16 of the electric element 14 and comprised of a first rotary compression element 32 (first stage) and a second rotary compression element 34 (second stage).

The sealed vessel 12 has a bottom portion which serves as an oil reservoir, and it is constituted of a vessel main body 12A which accommodates the electric element 14 and the rotary compression mechanism portion 18 therein and a substantial bowl shaped end cap (cover body) 12B which closes an upper opening of the vessel main body 12A. Further, a circular attachment hole 12D is formed at the center of a top face of the end cap 12B, and a terminal (wiring is eliminated) 20 used to supply a power to the electric element 14 is disposed to this attachment hole 12D.

The electric element 14 is a so-called magnetic pole concentrated winding type DC motor, and it is constituted of a stator 22 which is attached in an annular form along an inner peripheral surface of an upper space in the sealed vessel 12 and a rotor 24 which is inserted and set with a slight gap on the inner side of the stator 22. This rotor 24 is fixed to the rotary shaft 16 which runs through the center and extends in the perpendicular direction. The stator 22 has a laminated body 26 in which donut-like electromagnetic steel plates are laminated and a stator coil 28 wound at a tooth portion of the laminated body 26 by a series winding (concentrated winding) method. Furthermore, the rotor 24 is formed of a laminated body 30 of electromagnetic steel plates like the stator 22, and obtained by inserting a permanent magnet MG into the laminated body 30.

An intermediate partition plate 36 is held between the first rotary compression element 32 and the second rotary compression element 34. That is, the first rotary compression element 32 and the second rotary compression element 34 are constituted of the intermediate partition plate 36, an upper cylinder 38 and a lower cylinder 40 which are arranged above and below the intermediate partition plate 36, upper and lower rollers 46 and 48 which are eccentrically rotated by upper and lower eccentric portions 42 and 44 provided to the rotary shaft 16 with a phase difference of 180 degrees, vanes 50 and 52 which are in contact with the upper and lower roller 46 and 48 and compartmentalize insides of the upper and lower cylinders 38 and 40 into a low-pressure chamber side and a high-pressure chamber side, and an upper support member 54 and a lower support member 56 as support members which close an upper opening surface of the upper cylinder 38 and lower opening surface of the lower cylinder 40 and also function as bearings of the rotary shaft 16.

On the other hand, to the upper support member 54 and the lower support member 56 are provided intake paths 60 (intake path on the upper side is not shown) which communicate with the insides of the upper and lower cylinders 38 and 40 through non-illustrated intake ports, and discharge sound absorbing chambers 62 and 64 which are formed by partially forming concave portions and closing the concave portions with an upper cover 66 and lower cover 68.

It is to be noted that the discharge sound absorbing chamber 64 is caused to communicate with the inside of the sealed vessel 12 through a communication path which pierces the upper and lower cylinders 38 and 40 or the intermediate partition plate 36, an intermediate discharge tube 121 is erected at an upper end of the communication path, and a refrigerant gas with an intermediate pressure which is compressed by the first rotary compression element 32 is discharged into the sealed vessel 12 from this intermediate discharge tube 121.

Moreover, as the refrigerant, the above-described carbon dioxide ($CO_2$) which is friendly to the global environment and is a natural refrigerant is used in view of the combustibility, the toxicity and others. As an oil which is a lubricant, there is used an existing oil such as a mineral oil, an alkyl bezel oil, an ether oil, an ester oil, PAG (polyalkylene blycol) or the like.

On a side surface of the vessel main body 12A of the sealed vessel 12 are welded and fixed the intake paths 60 (upper side is not shown) of the upper support member 54 and the lower support member 56, the discharge sound absorbing chamber 62, and sleeves 141, 142, 143 and 144 which are provided at positions corresponding to the upper side (positions which substantially correspond to the lower end of the electric element 14) of the upper cover 66. Additionally, a refrigerant introducing tube 92B used to introduce a refrigerant gas to the upper cylinder 38 is inserted into and connected with the inside of the sleeve 141, and one end of this refrigerant introducing tube 92B communicates with a non-illustrated intake path of the upper cylinder 38. The other end of this refrigerant introducing tube 92B is connected with an outlet of an inter cooler 151 of an intermediate cooling circuit 150 as a later-described auxiliary cooling circuit. One end of the refrigerant introducing tube 92A is connected with an inlet of the inter cooler 151, and the other end of the refrigerant introducing tube 92A communicates with the inside of the sealed vessel 12.

One end of a refrigerant introducing tube 94 used to introduce the refrigerant gas to the lower cylinder 40 is inserted into and connected with the inside of the sleeve 142, and one end of this refrigerant introducing tube 94 communicates with the intake path 60 of the lower cylinder 40. Further, a refrigerant discharge tube 96 is inserted into and connected with the inside of the sleeve 143, and one end of this refrigerant discharge tube 96 communicates with the discharge sound absorbing chamber 62.

Furthermore, in FIG. 2, the above-described compressor 10 constitutes a part of a refrigerant circuit of the refrigerant cycle apparatus depicted in FIG. 2. That is, the refrigerant discharge tube 96 of the compressor 10 is connected with an inlet of a heat exchanger 154.

Here, the heat exchanger 154 is constituted of the inter cooler 151 of the intermediate cooling circuit 150 and a gas cooler 155, and a fan 111 which ventilates the inter cooler 151 of the intermediate cooling circuit 150 and the gas cooler 155 is provided. It is to be noted that the heat exchanger 154 in this embodiment is a micro-tube heat exchanger, and the gas cooler 155 is provided on the upstream side of the inter cooler 151 of the intermediate cooling circuit 150 with respect to ventilation by the fan 111.

Figure 3:
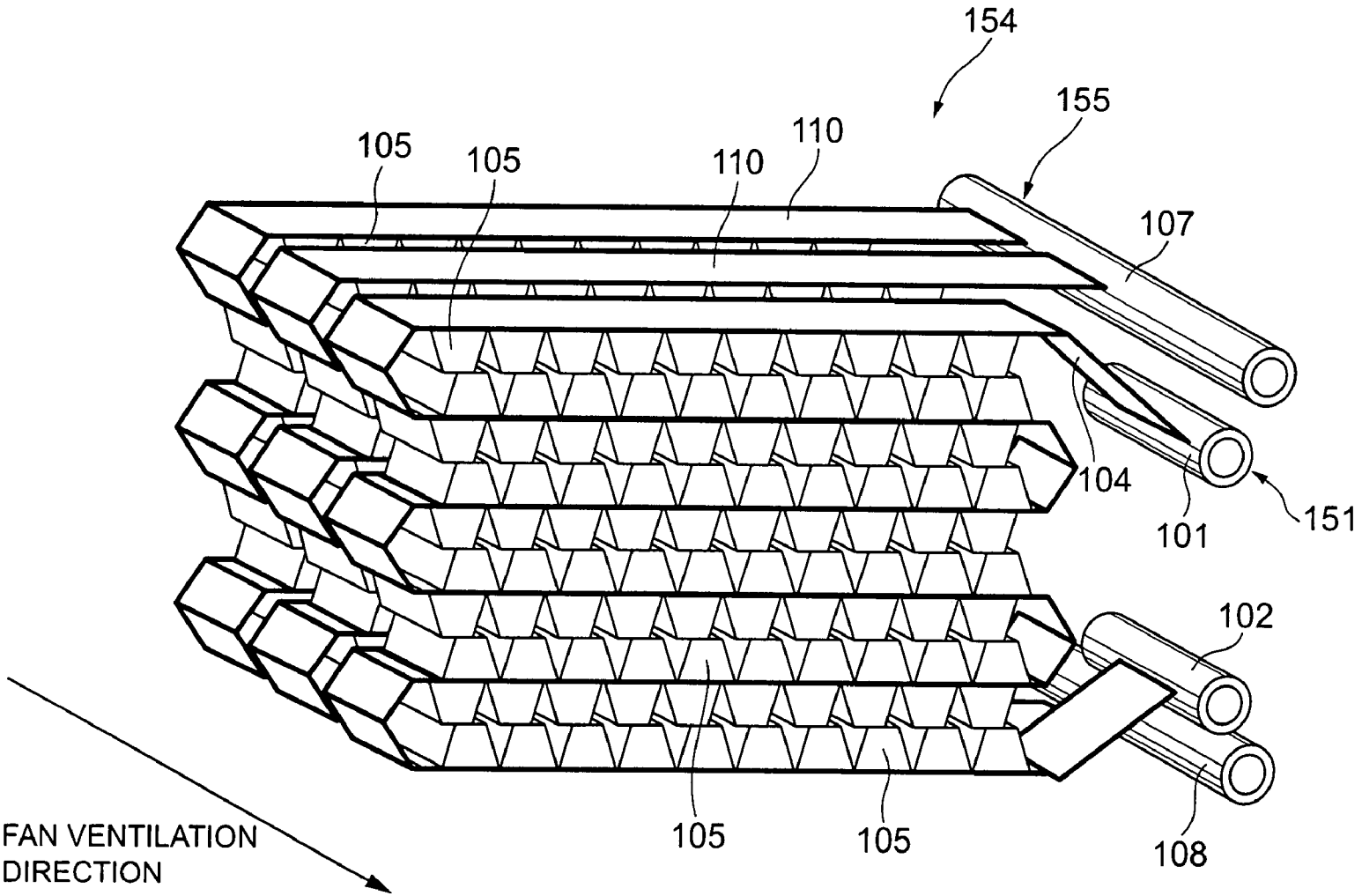
FIG. 3 is a perspective view of a micro-tube heat exchanger.
Figure 4:
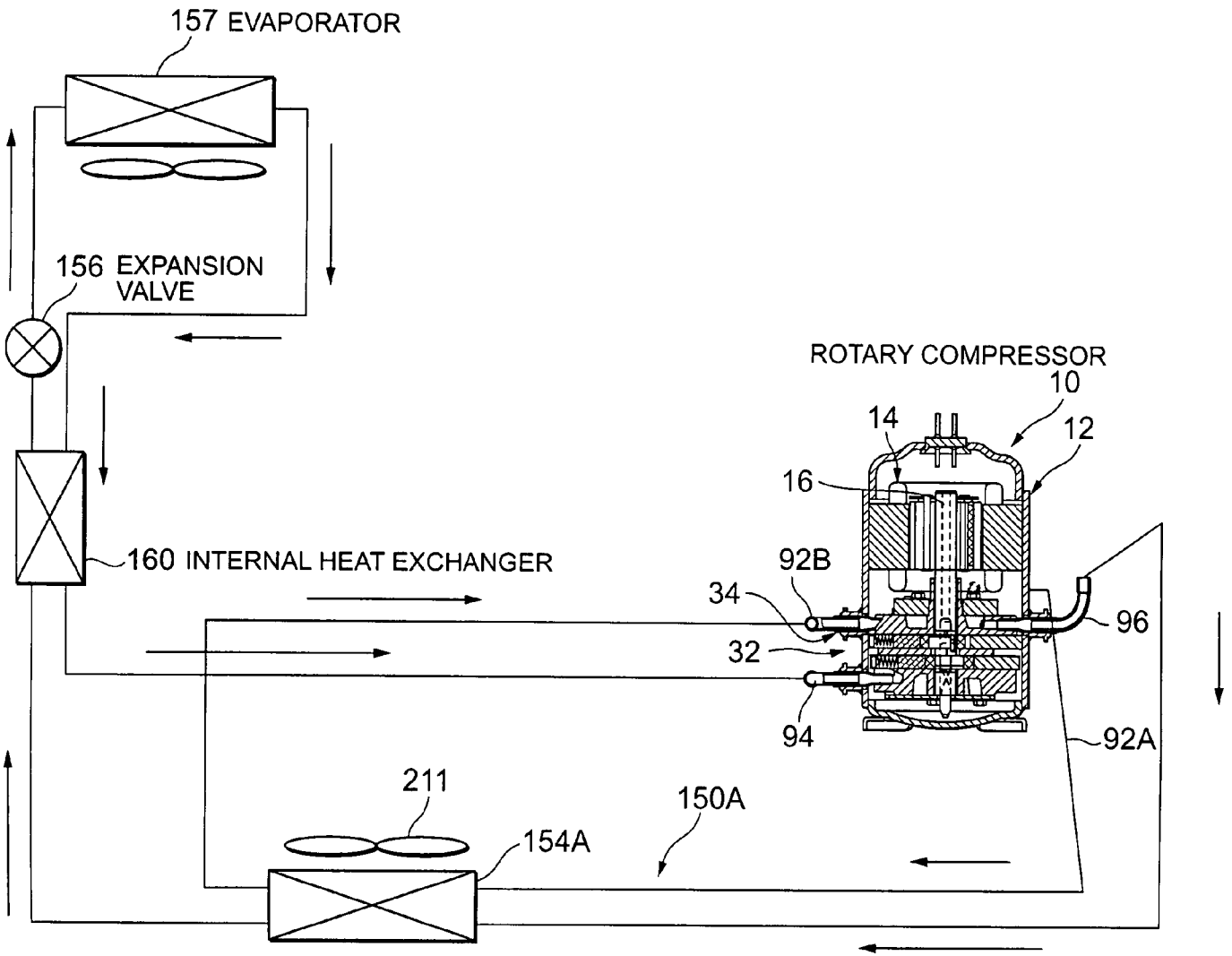
FIG. 4 is a refrigerant circuit diagram of a conventional refrigerant cycle apparatus.
Figure 5:
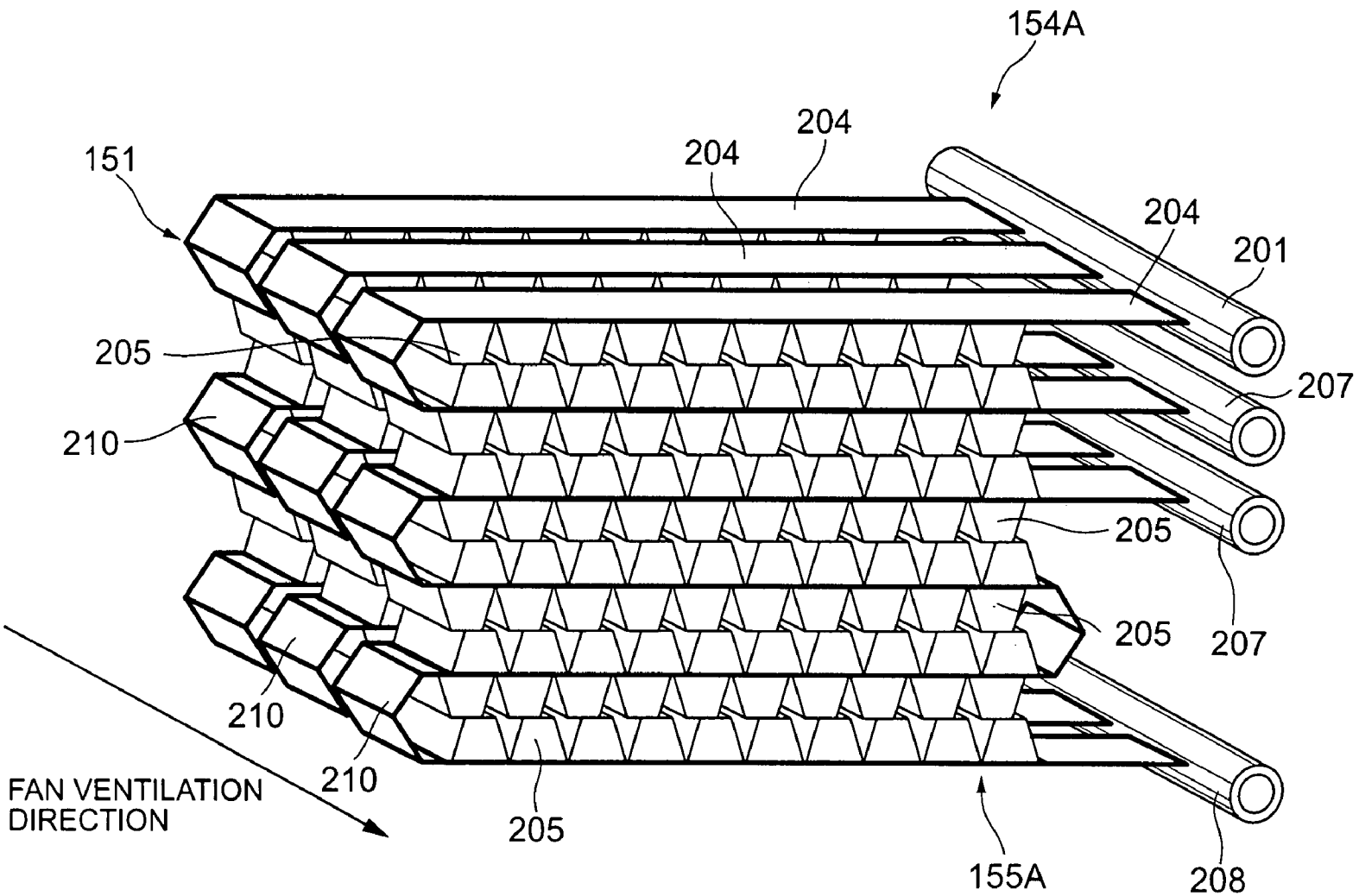
FIG. 5 is a perspective view of a conventional micro-tube heat exchangers.

A description will now be given as to the heat exchanger 154 with reference to FIG. 3. As shown in FIG. 3, the inter cooler 151 of the intermediate cooling circuit 150 is constituted of a header 101 at an inlet, a header 102 at an outlet, one micro-tube 104 and a plurality of fins 105. One end of the refrigerant introducing tube 92A which communicates with the inside of the sealed vessel 12 of the compressor 10 is connected with the header 101 at the inlet (not shown in FIG. 3). The header 101 is connected with one end of the micro-tube 104, and divides the refrigerant into a plurality of flows in small refrigerant paths formed in the micro-tube 104. The micro-tube 104 is formed into a meandering shape, and a plurality of fins 105 are attached to the meandering part. Furthermore, the other end of the micro-tube 104 is connected with the header 102 at the outlet of the inter cooler 151, and the refrigerants which flowed through the respective small refrigerant paths flow into each other here. The header 102 at the outlet is connected with the other end of the refrigerant introducing tube 92B caused to communicate with the intake path of the second rotary compression element 34 (not shown in FIG. 3).

Forming the micro-tube 104 in the meandering shape and attaching the plurality of fins 105 to the meandering part in this manner can assure the compact but large heat exchange area, and effectively cool the refrigerant gas with an intermediate pressure from the first rotary compression element 32 of the compressor 10, which flowed into the intermediate cooling circuit 150, by using the inter cooler 151.

On the other hand, the gas cooler 155 is constituted of a header 107 at an inlet, a header 108 at an outlet, two micro-tubes 110 and the fins 105, and the refrigerant discharge tube 96 of the compressor 10 is connected with the header 107 at the inlet (not shown in FIG. 3). The header 107 is connected with one end of each of the micro-tubes 110, and divides the refrigerant into a plurality of flows in small refrigerant paths formed in the respective micro-tubes 110. Each of the micro-tubes 110 is formed into a meandering shape like the micro-tube 104 of the inter cooler 151, and the plurality of fins 105 are disposed at the meandering part. Here, the micro-tube 104 of the inter cooler 151 and the fins 105 attached thereto have the same shapes as those of each of the micro-tubes 110 of the gas cooler 155 and the fins 105 attached thereto. That is, the inter cooler 151 of the intermediate cooling circuit 150 and the gas cooler 155 have substantially the same ventilation areas. Furthermore, the other end of each of the micro-tubes 110 is connected with the header 108 at the outlet of the gas cooler 155, and the refrigerants which flowed through the respective small refrigerant paths in the micro-tubes 110 flow into each other here. The header 108 at the outlet is connected with a pipe which passes through the internal heat exchanger 160.

Forming each micro-tube 110 into the meandering shape and attaching the plurality of fins 105 at the meandering part can assure the compact but large heat exchange area, and effectively cool the refrigerant gas with a high temperature and a high pressure from the second rotary compression element 34 of the compressor 10, which flowed into the heat exchanger 154, by using the gas cooler 155.

Moreover, since the gas cooler 155 is arranged on the upstream side of the inter cooler 151 of the intermediate cooling circuit 150 with respect to ventilation by the fan as described above, the heat radiation capability of the gas cooler 155 can be improved.

Additionally, a pipe led from the gas cooler 151 of the heat exchanger 154 runs through the internal heat exchanger 160. This internal heat exchanger 160 is used to exchange heat of the refrigerant on the high pressure side which flowed out from the gas cooler 155 of the heat exchanger 154 with heat of the refrigerant on the low pressure side which flowed out from the evaporator 157.

The pipe which runs through the internal heat exchanger 160 reaches an expansion valve 156 as throttling means. Further, an outlet of the expansion valve 156 is connected with an inlet of the evaporator 157, and the pipe which runs through the evaporator 157 is connected with the refrigerant introducing tube 94 through the internal heat exchanger 160.

Furthermore, the above-described intermediate cooling circuit 150 once releases heat of the refrigerant discharged from the first rotary compression element 32 of the compressor 10, and then returns the refrigerant to the second rotary compression element 34 of the compressor 10. The intermediate cooling circuit 150 is constituted of a refrigerant introducing tube 92A, a refrigerant introducing tube 92B and the inter cooler 151 of the heat exchanger 154.

An operation of the refrigerant cycle apparatus according to the present invention having the above-described structure will now be described. When a stator coil 28 of the electric element 14 of the compressor 10 is energized through a terminal 20 and a non-illustrated wiring, the electric element 14 is activated and the rotor 24 is rotated. The upper and lower rollers 46 and 48 fitted to the upper and lower eccentric portions 42 and 44 integrally provided with the rotary shaft 16 are eccentrically rotated in the upper and lower cylinders 38 and 40 by this rotation.

As a result, the refrigerant gas with a low pressure taken in to the low-pressure chamber side of the cylinder 40 from a non-illustrated intake port through the refrigerant introducing tube 94 and the intake path 60 formed to the lower support member 56 is compressed by operations of the roller 48 and the vane 52 and caused to have an intermediate pressure. It is then discharged into the sealed vessel 12 from the intermediate discharge tube 121 through a non-illustrated communication path extending from the high-pressure chamber side of the lower cylinder 40. As a result, the inside of the sealed vessel 12 has an intermediate pressure.

Then, the refrigerant gas with an intermediate pressure in the sealed vessel 12 flows out from the sleeve 144, enters the refrigerant introducing tube 92A, and passes through the intermediate cooling circuit 150. Furthermore, this intermediate cooling circuit 150 releases heat of the refrigerant based on an air cooling method by ventilation of the fan 111 of the heat exchanger 154 in a process that the refrigerant passes through the inter cooler 151 of the heat exchanger 154. Since passing the refrigerant gas with an intermediate pressure compressed by the first rotary compression element 32 through the intermediate cooling circuit 150 in this manner enables effective cooling, an increase in temperature in the sealed vessel 12 can be suppressed, and the compression efficiency of the second rotary compression element 34 can be also improved.

Moreover, the cooled refrigerant gas with an intermediate pressure is sucked to the low-pressure chamber side of the upper cylinder 38 of the second rotary compression element 34 from a non-illustrated intake port through a non-illustrated intake path formed from the refrigerant introducing tube 92B to the upper support member 54, compression at the second stage is performed by the operations of the roller 46 and the vane 50, and the refrigerant gas is turned into a refrigerant gas with a high pressure and a high temperature. This refrigerant gas passes through a non-illustrated discharge port from the high-pressure chamber side and it is discharged to the outside from the refrigerant discharge tube 96 through a discharge sound absorbing chamber 62 formed to the upper support member 54. At this time, the refrigerant is compressed to an appropriate supercritical pressure.

The refrigerant gas discharged from the refrigerant discharge tube 96 flows into the gas cooler 155 of the heat exchanger 154, heat of this gas is released based on an air cooling method by the fan 111 here, the refrigerant gas flows out from the heat exchanger 154 and then passes through the internal heat exchanger 160. Heat of the refrigerant is taken by the refrigerant on the low-pressure side, and further cooling is performed. The refrigerant gas on the high-pressure side cooled by the internal heat exchanger 160 reaches the expansion valve 156. It is to be noted that the refrigerant gas is still in the supercritical state at the inlet of the expansion valve 156. The refrigerant is turned into a gas/liquid two-phase mixture by a reduction in pressure in the expansion valve 156, and flows into the evaporator 157 in this state. The refrigerant is evaporated there, and demonstrates a cooling effect by performing the endotherm from air.

As described above, the refrigerant gas with an intermediate pressure compressed by the first rotary compression element 32 is caused to flow through the intermediate cooling circuit 150 including the inter cooler 151 in order to release heat, and an increase in temperature in the sealed vessel 12 is suppressed. By this effect, the compression efficiency in the second rotary compression element 34 can be improved. Furthermore, by passing the refrigerant gas through the internal heat exchanger 160 and exchanging heat with the refrigerant gas on the low-pressure side, the cooling capability (refrigerating capability) in the evaporator 157 can be improved.

Moreover, since the gas cooler 155 is arranged on the upstream side of the inter cooler 151 of the intermediate cooling circuit 150 with respect to ventilation of the fan 111 of the heat exchanger 154, the refrigerant having a high temperature and a high pressure which flows through the gas cooler 155 and is discharged from the second rotary compression element 34 can be effectively cooled.

As a result, the capability of releasing heat from the refrigerant in the gas cooler 155 can be improved. In particular, even if a refrigerant circulating quantity in the refrigerant cycle is large, the refrigerant having a high temperature and a high pressure discharged from the compressor 10 can be sufficiently cooled, and hence the cooling capability in the evaporator 157 can be improved.

Thereafter, the refrigerant flows out from the evaporator 157 and passes through the internal heat exchanger 160. The refrigerant takes heat from the refrigerant on the high-pressure side there and undergoes the heating effect. In this manner, the refrigerant is evaporated in the evaporator 157 and has a low temperature, and the refrigerant which flowed out from the evaporator 157 may enter a state that a liquid is mixed instead of a perfect gas state in some cases. However, when the refrigerant is caused to pass through the internal heat exchanger 160 and exchange heat with the refrigerant on the high-pressure side, a degree of superheat of the refrigerant is eliminated, and the refrigerant becomes a complete gas. As a result, return of the liquid that the liquid refrigerant is sucked into the compressor 10 can be assuredly prevented from occurring, and an inconvenience that the compressor 10 is damaged by liquid compression can be avoided.

It is to be noted that the refrigerant heated by the internal heat exchanger 160 repeats a cycle that it is sucked into the first rotary compression element 32 of the compressor 10 from the refrigerant introducing tube 94.

When the inter cooler 151 of the intermediate cooling circuit 150 has substantially the same ventilation area as that of the gas cooler 155 in this manner, manufacturing the micro-tubes having one shape which can be used for the both coolers can suffice, and hence the production cost can be decreased.

Additionally, like the above-described embodiment, when the gas cooler 155 is arranged on the upstream side of the inter cooler 151 of the intermediate cooling circuit 150 with respect to ventilation by the fan 111, the refrigerant having a high temperature and a high pressure which flows through the gas cooler 155 and is discharged from the second rotary compression element 34 can be effectively cooled.

As a result, even if a refrigerant circulation quantity in the refrigerant cycle is large, since the refrigerant having a high temperature and a high pressure discharged from the compressor 10 can be sufficiently cooled, the cooling efficiency (refrigerating efficiency) in the evaporator 157 can be improved.

On the other hand, when the inter cooler 151 of the intermediate cooling circuit 150 is arranged on the upstream side of the gas cooler 155 with respect to ventilation by the fan 111, the refrigerant having an intermediate pressure which flows through the inter cooler 151 and is discharged from the first rotary compression element 32 can be effectively cooled.

As a result, the capability of releasing heat from the refrigerant in the inter cooler 151 can be improved. In particular, in cases where the refrigerant cycle apparatus is used as a cooling apparatus for a super-low temperature such as a freezer, a flow path resistance of the expansion valve 156 must be increased in order to evaporate the refrigerant in a lower temperature area in the evaporator 157, or a temperature of the refrigerant which flows into the evaporator 157 must be reduced.

At this time, by cooling the refrigerant which is sucked into the second rotary compression element 34 by the intermediate cooling circuit 150, the operating performance of the compressor 10 can be improved, and an increase in temperature of the refrigerant discharged from the second rotary compression element 34 can be effectively suppressed. Therefore, the refrigerant can be evaporated in a super-low temperature area having a temperature not more than −30° C. in the evaporator 157, and the performance of the refrigerant cycle apparatus can be improved.

Based on this, the heat releasing capability of the gas cooler 155 of the heat exchanger 154 and the inter cooler 151 of the intermediate cooling circuit 150 in the refrigerant cycle apparatus can be easily optimized.

Therefore, the production cost of the refrigerant cycle apparatus can be considerably reduced. Further, the multiusability of the refrigerant cycle apparatus can be enhanced.

It is to be noted that the micro-tube heat exchanger 154 is used as the heat exchanger in this embodiment, but the present invention is not restricted thereto, and any other heat exchanger can be effective as long as it is a heat exchanger constituted of the gas cooler and the inter cooler of the intermediate cooling circuit.

Furthermore, although carbon dioxide is used as the refrigerant in this embodiment, the refrigerant is not restricted thereto, and various kinds of refrigerants such as a hydrocarbon-based refrigerant or nitrogen monoxide can be applied.

Moreover, the compressor 10 has been described by using the internal intermediate pressure type multistage (two-stage) compressive rotary compressor in this embodiment, but the compressor which can be used in the present invention is not restricted thereto, and a single-stage compressor can suffice. However, in this case, the auxiliary cooling circuit is used as a desuperheater.

Additionally, as the compressor, a multistage compressive compressor including two or more compression elements can suffice.

As described above, according to the present invention, there are provided the auxiliary cooling circuit which once releases heat from the refrigerant discharged from the compressor and then returns the refrigerant to the compressor, and the fan used to ventilate the auxiliary cooling circuit and the gas cooler. Further, the auxiliary cooling circuit has substantially the same ventilation area as that of the gas cooler. Therefore, for example, arranging the gas cooler on the upstream side of the auxiliary cooling circuit with respect to ventilation of the fan can effectively cool the gas cooler by air cooling ventilation.

As a result, even if a refrigerant circulation quantity in the refrigerant cycle is large, the refrigerant having a high temperature and a high pressure discharged from the compressor can be sufficiently cooled, and hence the cooling efficiency in the evaporator can be improved.

Furthermore, according to the present invention, the compressor includes the first and second compression elements in addition to the above, the refrigerant compressed by the first compression element and then discharged is sucked into the second compression element through the auxiliary cooling circuit, and this refrigerant is compressed and discharged to the gas cooler. Moreover, the auxiliary cooling circuit is arranged on the upstream side of the gas cooler with respect to ventilation by the fan. Therefore, the auxiliary refrigerant circuit can be effectively cooled by air cooling ventilation.

As a result, even if the refrigerant cycle apparatus is used as a cooling apparatus for a super-low temperature such as a freezer, cooling the refrigerant sucked into the second compression element by the auxiliary cooling circuit can improve the operating performance of the compressor, and effectively suppress an increase in temperature of the refrigerant discharged from the second compression element. Therefore, the refrigerant can be evaporated in a super-low temperature area having a temperature not more than −30° C. in the evaporator, thereby improving the performance of the refrigerant cycle apparatus.

Based on this, the heat releasing capability of the gas cooler of the heat exchanger of the refrigerant cycle apparatus and the auxiliary cooling circuit can be easily optimized at a low cost under use conditions.

Further, according to the present invention, in addition to each of the above-described inventions, since the auxiliary cooling circuit and the gas cooler are constituted of micro-tube heat exchangers, the heat releasing capability can be improved while reducing a size of each of the auxiliary cooling circuit and the gas cooler.

What is claimed is:

1. A refrigerant cycle apparatus, using carbon dioxide as a refrigerant, sequentially connecting a compressor, a gas cooler, throttling means and an evaporator, comprising:

an auxiliary cooling circuit which once releases heat from a refrigerant discharged from the compressor and then returns the refrigerant to the compressor, and a fan which ventilates the auxiliary cooling circuit and the gas cooler, wherein the auxiliary cooling circuit has substantially the same ventilation area, in the fan ventilation direction, as that of the gas cooler;

said compressor including first and second compression elements, wherein the refrigerant compressed by the first compression element and discharged is sucked into the second compression element through the auxiliary cooling circuit, compressed and discharged to the gas cooler; and an internal heat exchanger receiving high pressure coolant flowed out from the gas cooler and discharging said high pressure coolant to the throttling means, for exchanging heat from said high pressure coolant with low pressure coolant flowing from the evaporator, wherein said high pressure coolant has a supercritical pressure.

2. The refrigerant cycle apparatus according to claim 1, wherein the gas cooler is arranged on the upstream side of the auxiliary cooling circuit with respect to ventilation by the fan.

3. The refrigerant cycle apparatus according to claim 1, wherein the auxiliary cooling circuit and the gas cooler are constituted of micro-tube heat exchangers.

4. The refrigerant cycle apparatus according to claim 1, wherein the compressor includes more than two compression elements.

* * * * *